United States Patent [19]

Klygis

[11] Patent Number: 4,545,480

[45] Date of Patent: Oct. 8, 1985

[54] BOTTLE MULTI-PACKAGE AND MULTI-PACKAGING DEVICE

[75] Inventor: Mindaugas J. Klygis, Barrington, Ill.

[73] Assignee: Illinois Tool Works Inc., Chicago, Ill.

[21] Appl. No.: 542,879

[22] Filed: Oct. 17, 1983

[51] Int. Cl.[4] ..... B65D 71/00; B65D 75/00

[52] U.S. Cl. ..... 206/151; 206/150; 206/158

[58] Field of Search ..... 206/150–159, 206/161, 199; 294/87.2, 87.28

[56] References Cited

U.S. PATENT DOCUMENTS

| | | | |
|---|---|---|---|
| 2,989,177 | 6/1961 | Swick | 206/150 |
| 3,325,004 | 6/1967 | Wanderer | 206/150 |
| 3,330,408 | 7/1967 | Wanderer | 206/150 |
| 3,385,626 | 5/1968 | Wozniak | 206/150 |
| 3,608,949 | 9/1971 | Owen | 206/150 |
| 3,643,796 | 2/1972 | Arneson | 206/158 |
| 3,653,504 | 4/1972 | Saumsiegle | 206/161 |
| 4,139,094 | 2/1979 | Berry et al. | 206/148 |
| 4,249,766 | 2/1981 | Erickson | 206/150 |

*Primary Examiner*—William T. Dixson, Jr.
*Assistant Examiner*—Brenda J. Ehrhardt
*Attorney, Agent, or Firm*—Thomas W. Buckman

[57] ABSTRACT

A package for bottles utilizing a single sheet-like resilient carrier device positioned midway the body of the bottles and individually grasping the bottles. A pair of handles are designed to extend up from the plane of the carrier when applied to facilitate handling.

11 Claims, 4 Drawing Figures

BOTTLE MULTI-PACKAGE AND MULTI-PACKAGING DEVICE

BACKGROUND OF THE INVENTION

This invention is concerned with packages of bottles and the like, containers and carriers therefor. Such bottles are conventionally of the type including a generally cylindrical reduced neck portion diverging to a larger body portion. The neck openings may be closed in a variety of ways such as screw caps, pressed-on caps, plastic closures, etc. The closure is an important element because the contents of most of the bottles are pressurized and thus a reliable seal must be maintained. These types of bottles or containers may be and have been assembled in multi-packages through various forms of carriers or retainers. The containers are typically arrayed in a rank-and-row relationship usually in two parallel rows of three ranks and retained in that array for handling.

Typical of such efforts to multi-package such containers are paperboard wrap-arounds or partial wrap-arounds which either completely surround and encase the array, or partially surround the array in such a manner to prohibit inadvertent removal of the bottles during handling or storage. Such paperboard packages obviously have several disadvantages, a primary disadvantage being that the wrap-around material deteoriates due to moisture and thus the integrity of such a package is reduced considerably. Other packaging concepts utilized for such bottles include a top gripping carrier such as generally described in U.S. Pat. No. 4,139,094. This carrier relies upon a tab-like gripping of the bottle directly adjacent the cap. The material of the carrier must be relatively stiff to hold the bottles and keep them in the array using a one-piece device. While this package presents a generally attractive and somewhat acceptable package, it does inherently have the disadvantage of potentially damaging or prematurely breaking the seal in the caps as the bottles are being removed.

Many other efforts to produce a multi-package for such bottles include a two-part device such as a band member around the periphery of the array in conjunction with a flexible resilient plastic member associated with and joining the necks of the bottles, such as typified in U.S. Pat. No. 3,653,504. A similar technique of joining the top regions of the bottles and individually encircling the bottom regions of the bottle with plastic band is shown in U.S. Pat. No. 4,109,787.

SUMMARY OF THE INVENTION

The carrier of the device of the present invention is particularly designed for packaging bottles or the like in closely spaced parallel rows. The package created by the device of this invention is a compact array of bottles which are unitized by a single resilient sheet-like device positioned generally midway of the body portion of each bottle. The device is thus particularly designed to include finger gripping means which extend upwardly from the plane of location of the device on the bottles to a position which will provide a user or handler of such a packages with a suitable handle even though the device is situated directly adjacent the neck regions of the bottles.

Thus, the unique advantage of the package and the device of this invention is the utilization of a single sheet of resilient plastic flexible material which includes a plurality of apertures equal in number to the bottles to be packaged, dimensioned to frictionally and resiliently grip the body regions of the bottle. The device uniquely includes handle means formed in the flat sheet extending generally on either side of a lateral center line of the devices. The apertures created to receive the end ranks of bottles being of a different configuration than the apertures created to receive the middle rank in order to permit the handle means to lay flat prior to assembly with the bottles.

An object of the invention is thus to present a multi-package of bottle-like containers which includes a carrier device positioned midway the body portions of the containers but still affording a suitable finger-gripping means.

A further object of the invention is to provide a multi-package of bottles that is convenient to handle and incorporates a one-piece plastic device which reduces the pendulum or swinging effect of bottles being carried thereby.

An advantage of the present device is the configuration of a flat carrier device which permits a relatively long handle means to be situated wholly within the periphery of the device while not reducing the inner perimeter dimensions of the bottle receiving apertures.

The above and other objects of the invention will be apparent and fully pointed out in the detailed description and the accompanying drawings in which.

DETAILED DESCRIPTION OF THE PREFERRED EMBODIMENT

Figure 1:
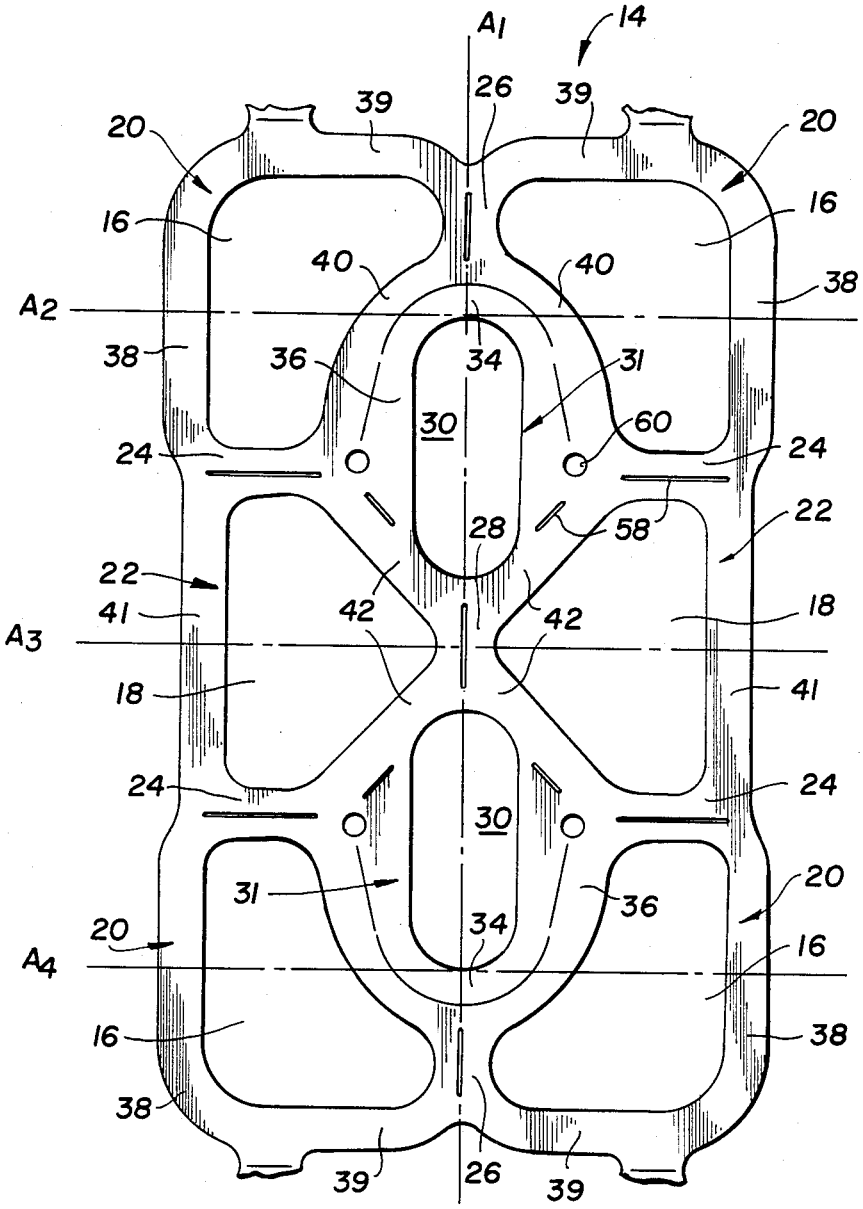
FIG. 1 is a plan view of the preferred embodiment of the carrier device of this invention.

Referring to the accompanying drawings and in particularly FIG. 1 at this time, one form of a carrier blank is shown before packaging the bottles. The blank or device 14 includes a plurality of apertures 16 and 18 arranged generally in ranks and rows and created by a series of interconnected bands 20 and 22.

It should be apparent from FIG. 1 that the apertures thus created are dissimilar in configuration with the apertures 16 created in the longitudinally end ranks being significantly different in configuration than apertures 18 in the middle rank. Thus, bands 20 which create apertures 16 are configured to be generally kidney-shaped with L-shaped band segments 38 and 39 at the corners and a generally curvilinear segment 40 interconnecting the corner segments. This aperture and band configuration is to be distinguished from the substantially triangular configuration of apertures 18 created by associated band segments 41 and 42 respectively.

In order to more clearly define the structural features of this invention, it is important to refer to various axes in the device. A longitudinal axis A1 is shown to bisect the device in a longitudinal direction. A plurality of lateral or rank axis bisect each rank and more particularly the outer band region of each rank. These rank axis are shown as A2, A3 and A4.

It is also important to note the locations of various webs which interconnect the bands of the invention. Lateral webs 26 and 28 are situated on the longitudinal axis A1 and connect adjacent pairs of apertures in a given rank. Longitudinal webs 24 connect adjacent pairs of apertures in a given row. It is particularly important to note, for purposes to be described later, that webs 26 which connect bands 20 in longitudinally end ranks are situated on the outside or longitudinally beyond the associated rank axes A2 and A4, whereas, lateral web 28 not only is on the longitudinal axis but is also on the rank axis A3.

A further important structural feature of the invention resides in the relationship between lateral outermost band segments 38 and 41, of each of the apertures. It is to be noted for purpose to be defined later, that band segments 38 extend laterally beyond band segments 41.

As noted earlier herein, an important feature of this invention is the use of a single, flexible, resilient device which is capable of being conveniently handled even though it is designed to be positioned on the bottles significantly below the neck regions of the package. Therefore, attention is directed to handle means 31 which is configured by a slit 32 adjacent the curvilinear innermost bands 40 of the outer rank of apertures. A suitably dimensioned finger aperture 30 is oval in shape to enable the handle means 31 to be of sufficient length to be grasped even though the carrier device per se is positioned downwardly from the cap regions of bottles. Each handle means 31 extends outwardly on opposite side of middle rank axis A3 through a pair of legs 36 connected on either side of longitudinal axis A1 to inner band segments 42. The legs are connected at the other extremities by a U-shaped bight region 34.

Figure 3:
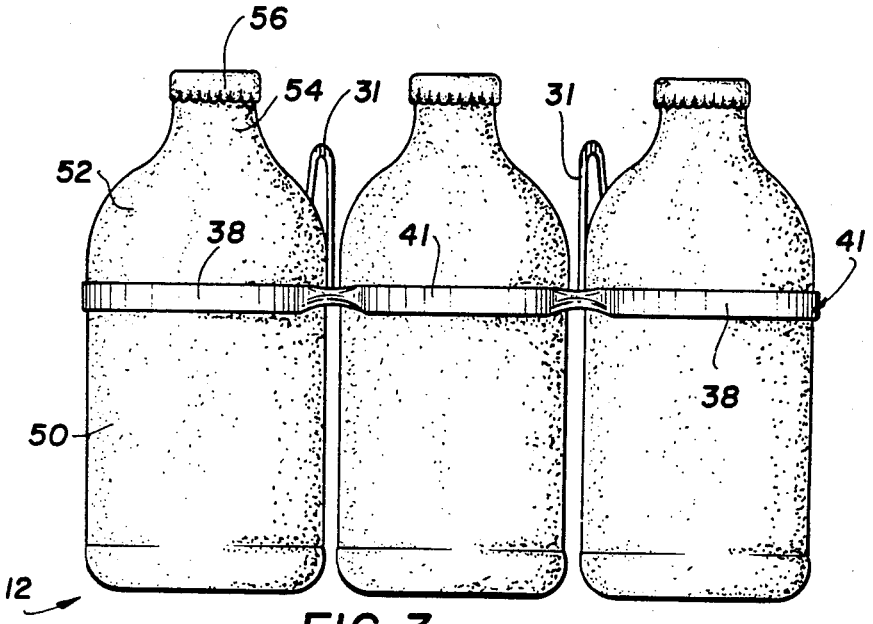
FIG. 3 is a side view of the multi-package which includes the device shown in FIG. 1.
Figure 4:
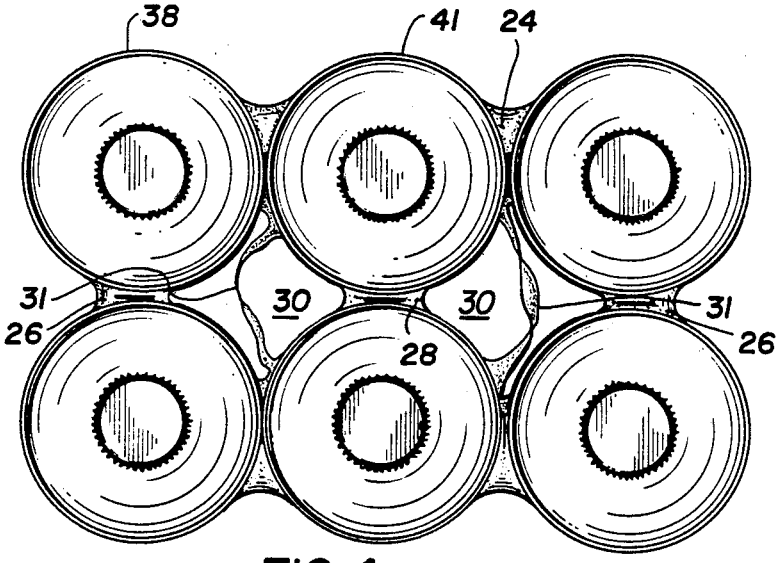
FIG. 4 is a top plan view of the multi-package incorporating the packaging device of FIG. 1.

In practice, as shown in FIGS. 3 and 4, the apertures 16 and 18 are of a peripheral dimension slightly smaller than the outer diameter of the body portion of the bottles to be packaged. Each bottle 12 includes a body region 50 joined to a neck region 54 of greatly reduced diameter by a transitional shoulder means 52. The neck region includes an opening 56 with any suitable cap or seal means.

Each of the apertures 18 and 20 of the device 14 are slightly stretched to receive the bottles 12, which have been placed in a closely spaced array defined by rows and ranks. The carrier device 14 is forced downwardly until it is generally midway of the top region of the body portion. The bands are then released and resiliently and frictionally engage the body regions. In positioning the bands which are integrated by web means of the device about the bottles, two events occur. Firstly, the static forces of the bottles being gripped by the band tends to rotate the end ranks 20 so that the lateral web means 26 are positioned generally along the center lines defined by that particular rank of bottles. When this is done certain forces are exerted on the middle rank bands 22 essentially moving outer bands 41 of the middle rank outwardly. Thus if the outer band segments of the inner rank were not displaced inwardly from the outer band segments of the end ranks an array of bottles would be created with rows which were not parallel. A carrier which did not have the dissimilar outer band extensions and were otherwise configured in accordance with this invention would create a bulge in the array.

Other features which increase the effectiveness and efficiency of a carrier of this type are depressions 58 to facilitate pivoting of various regions of the device about alone a certain line and punch out areas 60 which eliminate the tendency of the forces of carrying the device tear the rather thin device.

Figure 2:
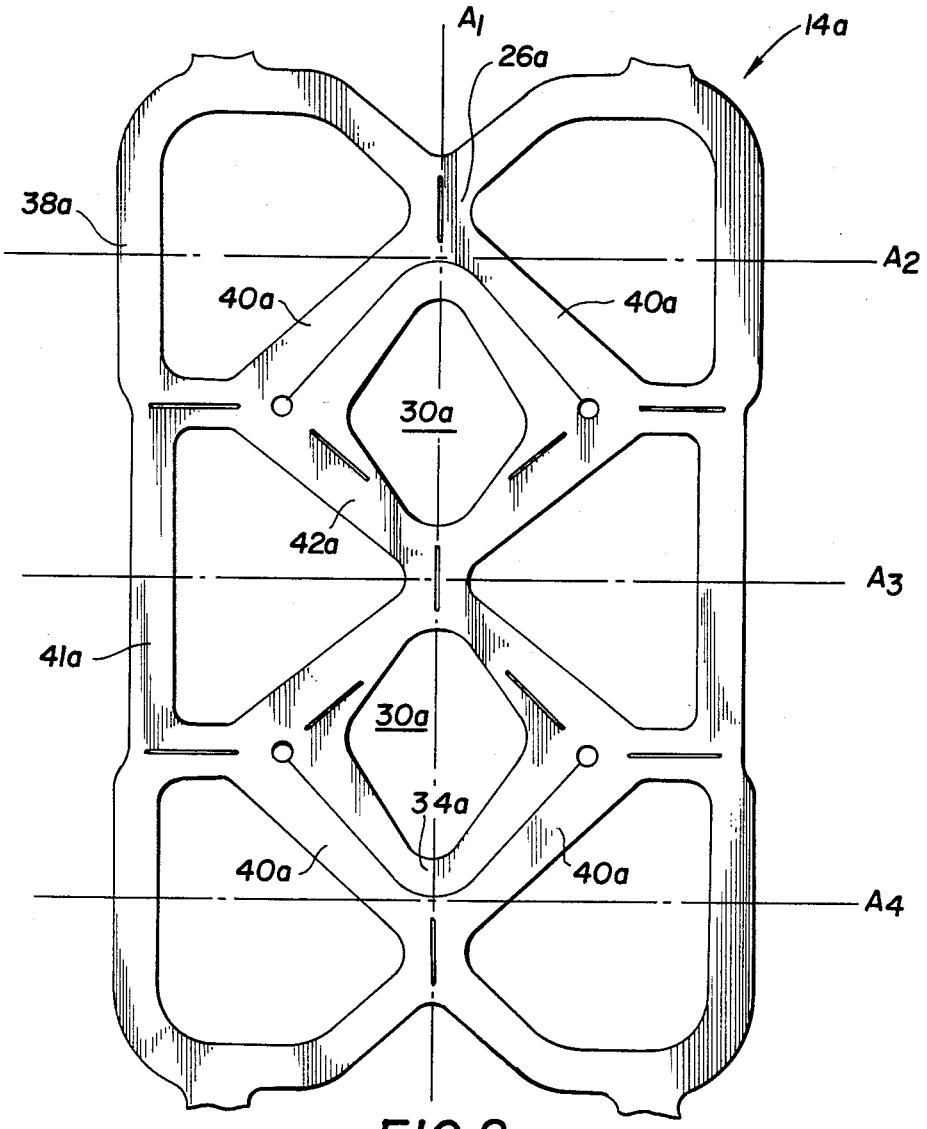
FIG. 2 is a plan view of an alternate embodiment of the carrier device incorporating this invention.

In FIG. 2 a modification of the device described below is referred to by similar reference numerals with the suffix of "a" assigned to similar elements. It will be noted that the significant difference in the embodiments of FIGS. 1 and 2 will be in the configuration of the finger gripping means. The aperture **30*a* is significantly wider to permit easier finger entry. The bight region 34*a* in relationship to the legs 36*a* is more V-shaped than the above embodiment. The innermost band regions 40*a* are thus straight rather than curvilinear segments of the above embodiment. This embodiment provides a somewhat shorter finger gripping means but larger aperture. The dissimilar apertures and positionment of lateral webs 26*a* on the outside of the end rank axes and the spacing or displacement of the lateral outermost band section 38*a* from outer most band segments 41*a*** remain with the functions of these structures being similar to the functions of similar structure in the first described embodiment.

It will be understood that other variations and modifications may be effected without departing from the spirit and scope of the novel concepts disclosed and claimed herein.

I claim:

1. A package making device for unitizing a plurality of containers, the device formed from a resilient, elastic and deformable sheet of plastic material, said device comprising two rows and three ranks of integrally connected narrow bands creating reconfigurable container receiving and gripping apertures, a longitudinal axis intersecting the transverse dimension of the device and situtating the rows on opposing sides thereof, each rank including a rank axis perpendicularly disposed to the longitudinal axis and intersecting the outer band segment of each aperture at points generally midway between the longitudinal extremities of said outer band segments, the outer band segments of each aperture are substantially straight, the longitudinally adjacent aperture creating bands being interconnected by longitudinal webs located primarily at the juncture of the longitudinal adjacent straight segments, said longitudinal webs being located solely on the outboard side of a center line extending through rows of apertures, the major portion of the area of the apertures of the ranks at each longitudinal extremity of the device being disposed longitudinally outwardly of the respective rank axis, a pair of finger gripping members, extending from both sides of the rank axis of the longitudinal innermost ranks, the gripping members including a pair of legs interconnected by a bight region, the legs of the gripping members integral with the inner band regions of said inner most rank of apertures, the bight region of each finger gripping member being generally on the rank axis of the longitudinal outermost ranks wherein two independent finger gripping loops are created along the longitudinal axis of the package with the outer margin of the members having a configuration complimentary to the inner band regions of the outermost ranks so they may lay flat in the plane of the device prior to application and extend upwardly from the plane subsequent to the application.

2. The package making device of claim 1 wherein the outer band segments of each aperture are substantially straight.

3. The package making device of claim 2 wherein longitudinally adjacent aperture creating bands are interconnected by longitudinal webs located primarily at the juncture of the longitudinal adjacent straight segments.

4. The package making device of claim 3 wherein the longitudinal webs are located solely on the outboard side of a center line extending through rows of apertures.

5. The package making device of claim 1 wherein the outer band segments of the ranks at each longitudinal extremity extend laterally outwardly of the outer band segments of the innermost rank of apertures.

6. The package making device of claim 1 wherein the finger gripping loops are c-shaped.

7. The package making device of claim 1 wherein the finger gripping loops are V-shaped.

8. A package making device for unitizing a plurality of containers, the device formed from a resilient elastic deformable sheet of plastic material and comprising at least two rows and three ranks of integrally connected bands creating reconfigurable container receiving and gripping apertures, a longitudinal axis defined substantially midway between the lateral edges of the device, the rows being situated on opposing sides of said longitudinal axis a plurality of rank axes perpendicularly disposed to said longitudinal axis, each rank axis arranged to intersect the laterally outer band segments at points midway the longitudinal extremities of each of said segments, lateral web means lying on the longitudinal axis integrally connecting pairs of apertures located on either side of the longitudinal axis, the lateral web means which connect the middle rank of apertures being located on the rank axis for said middle rank while the lateral web means which connect the longitudinal outer ranks are located longitudinally outwardly of the rank axis for said longitudinal outer ranks, a pair of finger gripping members each including a bight portion and pair of leg portions extending from the inner band regions of the bands in the middle rank of apertures with the legs of each finger gripping member emanating from a region of the device located adjacent the longitudinal web means.

9. The package making device of claim 8 wherein the transverse dimension of the device taken along the rank axis of the longitudinally outer ranks is greater than the transverse dimension taken along the rank axis of the middle rank.

10. A bottle multi-package including an array of rows and ranks of closely spaced containers, each container having a base, cylindrical body portion, reduced diameter neck portion, a dispensing opening at the extremity of the neck portion, and a transition shoulder portion between the neck portion and body portion, a sole unitizing and carrying device located generally midway the shoulder portion and the base, the device including a plurality of resilient bands creating apertures smaller than the diameter of the body but greater than the diameter of the neck region, said bands integrated by web means, the bands frictionally engaging the outer walls of the body portion in such a manner as to remain in position when lifting forces are applied to the multi-package through the device, finger gripping means integral with the device located generally between the rows and on either side of the middle rank of containers.

11. The multi-package of claim 10 wherein the finger gripping means are a pair of loop members extending from the plane of the device upwardly to a point substantially at the neck regions of the bottles to facilitate gripping and handling.

* * * * *